US009328994B2

(12) United States Patent
Hovsepian

(10) Patent No.: US 9,328,994 B2
(45) Date of Patent: May 3, 2016

(54) FLEXIBLE SWITCH FOR LASER GUN SIGHT

(71) Applicant: Richard George Hovsepian, Alachua, FL (US)

(72) Inventor: Richard George Hovsepian, Alachua, FL (US)

( * ) Notice: Subject to any disclaimer, the term of this patent is extended or adjusted under 35 U.S.C. 154(b) by 20 days.

(21) Appl. No.: 14/336,263

(22) Filed: Jul. 21, 2014

(65) Prior Publication Data

US 2015/0267999 A1 Sep. 24, 2015

Related U.S. Application Data

(60) Provisional application No. 61/892,700, filed on Oct. 18, 2013.

(51) Int. Cl.
*F41G 1/35* (2006.01)

(52) U.S. Cl.
CPC ..... *F41G 1/35* (2013.01)

(58) Field of Classification Search
CPC ..... F42B 12/42; F42B 12/36; F42B 8/26; F42B 12/52; F41G 1/36; F41G 11/001; F41G 11/004; F41C 27/00; F21V 7/04; F41A 33/02
USPC ..... 42/117, 146
See application file for complete search history.

(56) References Cited

U.S. PATENT DOCUMENTS

| | | | | |
|---|---|---|---|---|
| 5,194,007 | A * | 3/1993 | Marshall | F41G 3/2616 42/114 |
| 5,485,695 | A | 1/1996 | Glock | |
| 5,495,675 | A | 3/1996 | Huang | |
| 5,654,594 | A | 8/1997 | Bjornsen | |
| 5,706,600 | A * | 1/1998 | Toole | F41G 1/35 362/114 |
| 7,845,817 | B1 * | 12/2010 | Miller | F41G 1/35 362/110 |
| 8,256,154 | B2 * | 9/2012 | Danielson | F41G 1/35 42/117 |
| 2011/0003269 | A1 * | 1/2011 | Portoghese | F41A 33/02 434/18 |
| 2013/0185982 | A1 * | 7/2013 | Hilbourne | F41G 1/35 42/117 |

* cited by examiner

*Primary Examiner* — Troy Chambers
*Assistant Examiner* — Bridget Cochran
(74) *Attorney, Agent, or Firm* — Sven W. Hanson

(57) ABSTRACT

A handgun mounted laser sight that is combined with a trigger-guard mountable switch with flexible connections that accommodate various different geometries of handgun frames. A flush surface-mounted switch secured to the underside of the handgun trigger guard contacts mating the laser sight are located on the downward facing surface of the gun frame forward of the trigger guard. The switch is designed and located to provide passive user switching in use without separate movement or applied force of the user's hand or fingers.

8 Claims, 3 Drawing Sheets

FLEXIBLE SWITCH FOR LASER GUN SIGHT

RELATED APPLICATIONS

This application claims benefit of a U.S. Provisional application filed by the same applicant on Oct. 18, 2013 and having an application No. 61/892,700.

BACKGROUND OF THE INVENTION

The present invention pertains to switching mechanisms used to operate and power associated laser sights used on handguns. There are many designs of handgun sights that project a laser-produced light beam as a guide for aiming. One of the important features of any laser sight is the manner in which it is switched or powered-on for use. A laser sight is typically unpowered prior to use, but there are many known reasons why it is desirable that the laser be easily and quickly switched on by the user prior to or during aiming. Particularly during events associated with self-defense, when a handgun must be used as a weapon, the ability to switch on a weapon's laser sight without significant mental or physical effort is acknowledged to be critical.

Various laser sight power switches have been developed in the past that attempt to address this need. Some prior art designs have used a switch placed on the handgun grip—operable by the user's middle finger. However, in operation of handguns, there is a phenomena in some users that is referred to as "limp wristing" in which a handgun user does not firmly grasp the handgun grip with the middle finger, but allows that finger to maintain a position curved forward of the grip, under the trigger guard. This event is a problem when the middle is intended and needed to operate a laser sight switch. In such a case, a laser switch located under the trigger guard and on the grip, such as is typified by the designs illustrated in U.S. Pat. No. 8,256,154 to Danielson et al., may not successfully function.

What is desired is a switch to enable powering a laser sight in a handgun that functions without conscience effort by the user and will be effective even when the user's middle finger is not firmly grasping the handgun grip.

Moreover there is a need to provide methods and devices for adaptable mounting laser sights to a variety of gun frames that have different shapes and configurations.

SUMMARY OF THE INVENTION

The invention provides an adaptative mounted laser sight that may be combined with a trigger-guard mountable switch with flexible connections that accommodate various different geometries of handgun frames. The invention includes a laser sight having exterior surface contacts that mate to inventive contacts mounted on an underside surface of a conventional handgun frame. The contacts are located on the frame such that, when the laser sight is mounted on the frame, the mating contacts will form an electrical connection. The contacts are connected to a flush surface-mounted switch secured to the underside of the handgun trigger guard such as to provide passive user switching in use. The connecting electrical leads are flexible and configured to be surface-mounted on the handgun to allow for various geometries.

The invention includes a kit including a low-profile flush switch configured to be surface-mounted on a handgun trigger guard, one or multiple or adjustable, flexible traces to connect the switch to contacts located under the forward portion of the handgun barrel, and a laser light device configured to be mounted under the handgun barrel and electrically connecting to the contacts. The kit is configured to be applied to any of a great range of handgun geometries to provide a handgun-mounted switch controlled laser light sight. The kit may include multiple flexible carriers including the switch, traces and contacts, each carrier having a different geometry to accommodate different handguns.

The invention includes a method of improving existing and future handguns by securing a trigger guard mounted electric switch and a laser sight to provide passive user operation of a laser sight during use of the handgun. The invention also includes a method of mounting and controlling a laser sight on a handgun in which a flush switch is surface-mounted to a trigger guard, flexible electrical leads are surface-mounted to the trigger guard and gun frame forward of the trigger guard to connect to an electrical contact there. A laser sight with electrical contacts is then mounted to the gun frame to connect the laser sight contacts with those on the gun frame to enable the switch to control the laser sight operation.

Other novel aspects and benefits of the invention are made clear from the following description of detailed embodiments and the associated drawing figures. While the invention is discussed in regards to handguns, the same concepts are applicable to other firearms having the same structural features enabling the invention.

DESCRIPTION OF EMBODIMENTS OF THE INVENTION

Figure 1:
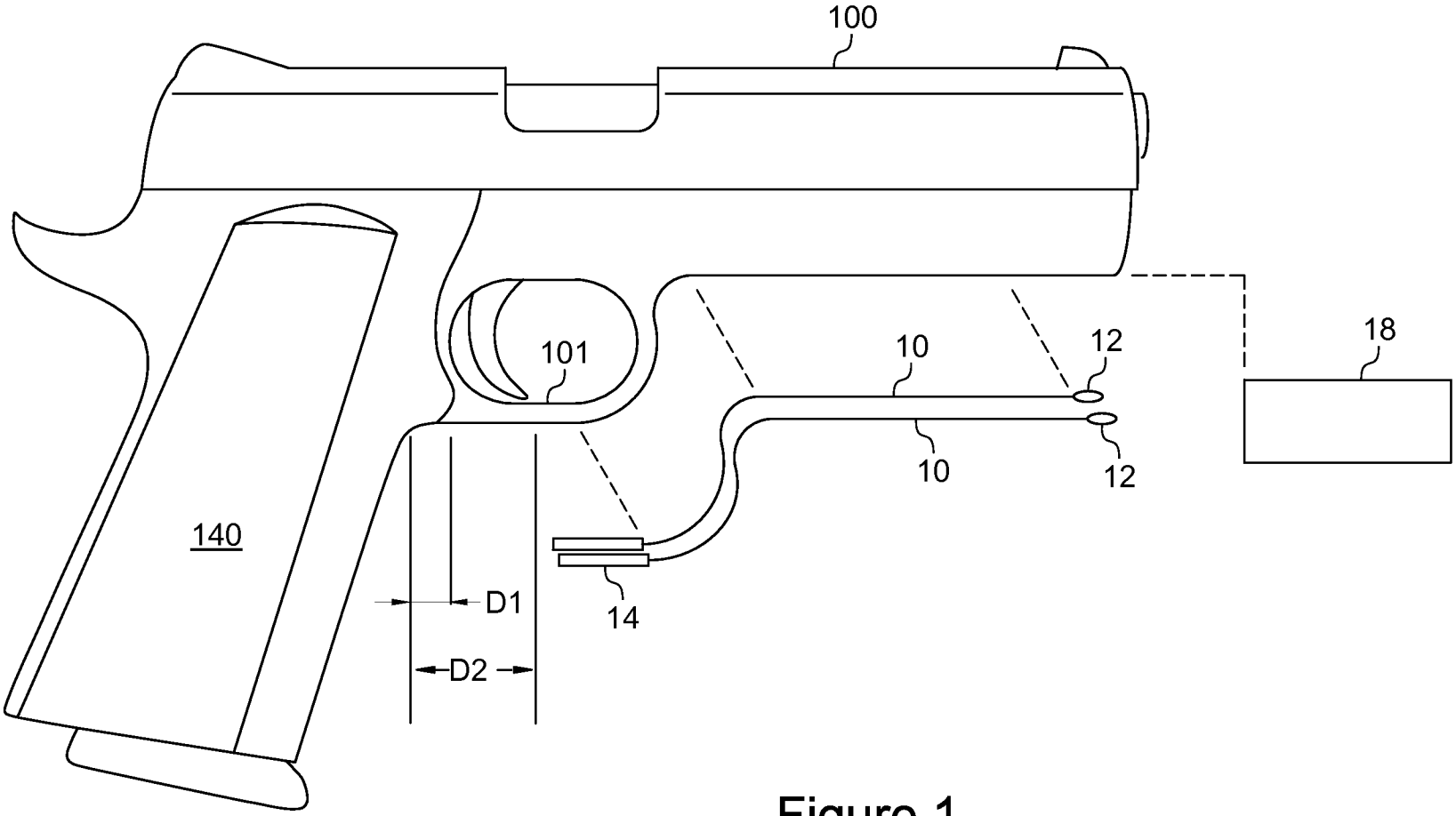
FIG. 1 is a side view of the inventive laser system.
Figure 2:
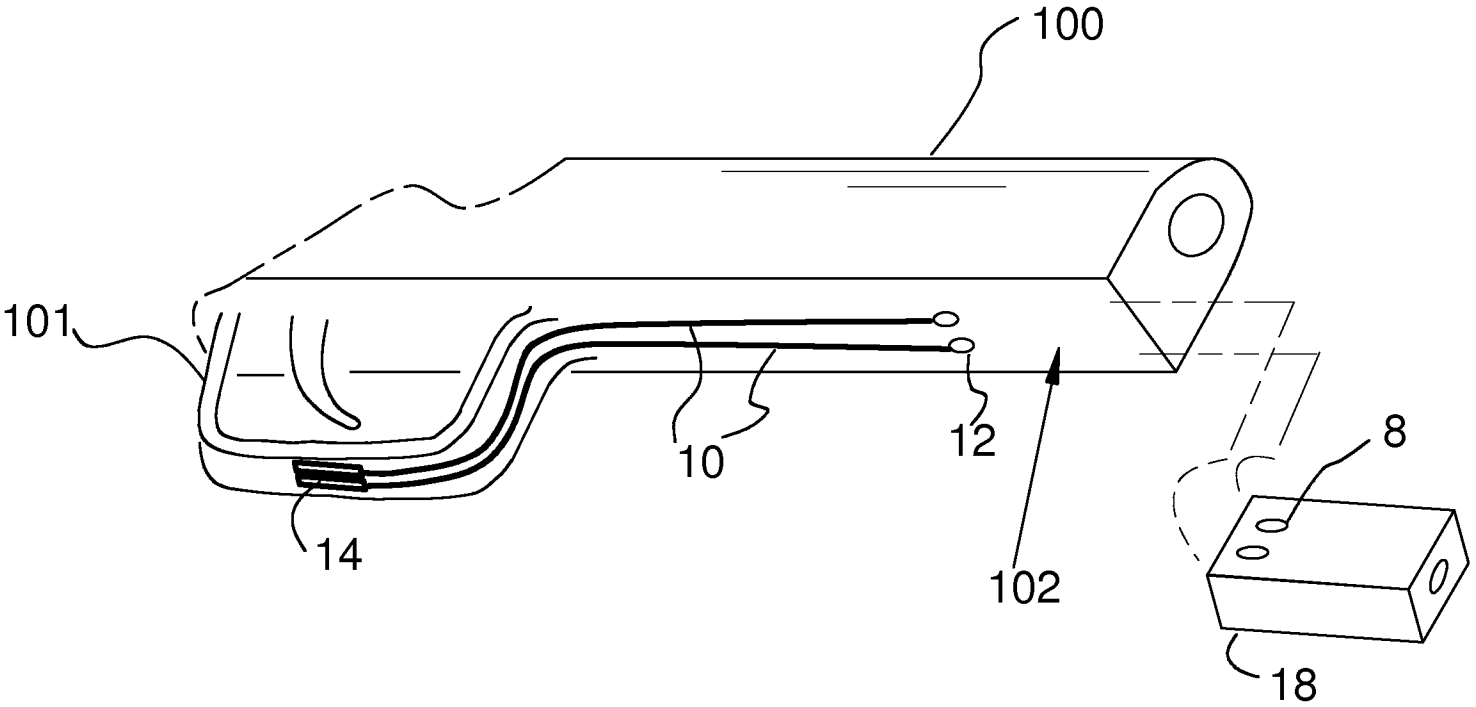
FIG. 2 is a perspective view of the underside of a portion of a conventional handgun incorporating the inventive laser system.

FIGS. 1 and 2 illustrate some of the fundamental components of the inventive laser sight system. In FIG. 1, a laser sight 18 and components of a switch 14 and connecting elements are illustrated separated from the associated handgun 100. The handgun is representative of any of various handguns that may have different shapes or forms. FIG. 2 illustrates the switch 14 and connecting elements mounted on the handgun 100. The laser sight 18 is configured to be removably mounted to a conventional handgun 100 through existing hardware features. The laser sight 18 in FIG. 2 is shown unmounted from the handgun 100 and rotated to better reveal the inventive aspects of the device. The manner and devices for mounted the laser sight 18 may include those conventionally found on handguns. Preferably, a picatinny rail system is provided with respective mating structures on the handgun 100 and the laser sight 18 to provide a securing structure. The details of the mating mounting elements are not illustrated.

The laser sight 18 also includes electrical sight contacts 8 located on an external surface of the laser sight 18. These sight contacts 8 are electrically connected to the laser sight power and control circuitry to allow the functions herein required. The laser sight circuitry will require modification from conventional designs to allow these functions, but otherwise, may follow conventional designs and function.

Mating contacts 12 are located on a downward facing undersurface 102 of the handgun. Their location and configuration are such that when the laser sight 18 is mounted as intended onto the handgun 100, the sight contacts 8 and mating contacts 12 are physically in contact to provide electrically connectivity between them. Preferably the undersurface 102 is horizontal (relative to normal operational attitude of the handgun), however a slightly angled surface may be accommodated by adjusting the angular orientation of the laser elements in the laser sight 18.

A switch 14 is located on the underside surface of the handgun trigger guard 101. The switch 14 is surface-mounted in form and function with a profile that is effectively flush with the surrounding surface of the trigger guard. This "flush" characteristic defines a construction and geometry where the switch 14 does not protrude substantially from the surface on which it is mounted (trigger guard downward facing surface). This characteristic further specifies a configuration that does not create a physical impediment to a user's finger's movement, forward and backward, over the surface. Details of the switch 14 are provided below.

The switch 14 is connected to the mating contacts 12 through electrically conducting flexible traces 10. The traces 10 are surface-mounted and flush and follow and are secured to the outside surface of the handgun 100 between the switch 14 and the mating contacts 12. Generally in the invention, when the laser sight 18 is mounted to the handgun 100 to connect the mating contacts 12 to the sight contacts 8, the power and operation of the laser sight 18 are thereby controlled by operation of the switch 14.

The contacts 8, 12, switch 14 and flexible traces 10 are constructed and configured to enable them to adapt to a variety and range of handgun geometries and surface contour and allow these components to be applied to existing handguns without prior knowledge of the handgun geometry or shape. This requires that the switch 14 and traces 10, at least, are physically flexible while maintaining electrically conductivity. Because the inventive system is intended for use by consumer users without access to any but the simplest tools, the construction of these components must be durable and securable with simple materials.

Preferably, the mating contacts 12, traces 10 and switch 14 are integrally formed as a conductive metallic matrix deposited on a polymer film ribbon. Both the mating contacts 12 and the traces 10 may be mounted using any of a variety of structural adhesives such as epoxy adhesive. For use on metal gun frames, the film ribbon is required to provide effective electrically insulating characteristics. A significant advantage to this novel construction is the ability to adjust overall length of the device, from contacts 12 to the distal end of the switch 14, by simply cutting off a portion of the distal end of the switch 14.

Alternatively, the switch 14 and mating contacts 12 may be each separately formed of solid metal foil and secured to the handgun 100, separately from the traces 10, but joined to establish the required electrical connectivity.

Preferably, the contacts 12 have a surface diameter dimension of about four (4) millimeters while the traces 10 may have a width dimension in the range of four (4) to seven (7) millimeters. When a film ribbon carrier is used, the trace 10 height (above the handgun surface) is about 0.17 millimeter and must be less than 0.5 millimeter to satisfy the flush geometry requirement and its function.

The length of the trace 10, from the contacts 12 to the switch 14 may be altered to accommodate different configurations and shapes of handguns. Inventive kits may be provided with any of a variety, or multiple of, or adjustable length, traces to allow the user to fit the components on a handgun frame that is not predetermined.

The switch 14 must be operable by the user on simple contact, with and without a contact force against the surface, of the user's finger on any portion of the exposed surface of the switch 14 extending over the effective length of the switch 14. The switch 14 may function through use of electrically separated contact poles that are bridged by contact by the users finger.

It is critical that the configuration of the switch 14 enable powering of the laser sight as a consequence of the natural and inevitable handling of the associated handgun by a user. No additional motion or force can be required to be carried out by the user, as such might render the system unlikely to be operated when most critically needed and when the user is most likely to fail to effect switching to power the sight. Particularly, the user must not be required to move any of the gripping fingers or a trigger finger upward nor exert an upward force.

For this function, the switch 14 must be configured to function whenever a human finger is located anywhere within an effective switching range SL forward of a point on the grip 140 at its junction with the bottom of the trigger guard 98. Experimentation by the inventor here has determined that the effective switching length SL is dependent on the size of a typical human user's finger and the furthest distance from the grip 140 that a user might place their finger if they did not fully grasp the grip with the middle finger. On this basis, it has been found that the switch 14 itself should have an effective length that extends, at a minimum, from a first location distance D1 of 0.25 inches (6 millimeters) forward from the grip to a second location distance D2 of 0.625 inches (16 millimeters) forward from the grip. This results, in one embodiment with a shortest physical switch length (D2−D1), with a switch length of 0.375 inches (9.6 millimeter). The switch 14 may extend closer to the grip 140 if the particular switch design requires it, but the D1 dimension defines a maximum gap from the grip that effective switching need not be provided. From that maximum gap to the D2 dimension point, switching control must be provided to provide the necessary passive operation. The switch 14 may also be operable at a distance further from the grip 140, but such is believed unnecessary.

The laser sight 18 may have the general construction and design of any of many prior laser sight devices, that also has provided sight contacts 8 on or extending from an upper surface of the sight 18 such as to enable connection with the mating contacts 12.

Figure 3:
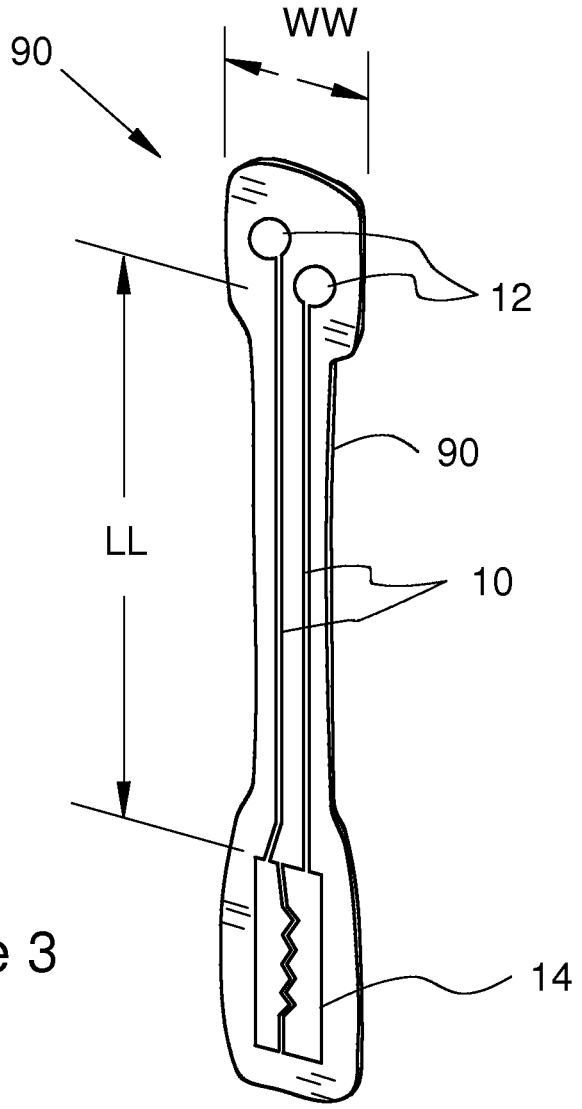
FIG. 3 is a perspective view of a flexible surface-mount carrier including a passive switch and laser sight power contacts according to the invention.

FIG. 3 is a perspective illustration of an integrated carrier 90 according to the invention. The carrier 90 includes a flexible substrate body 92 that is sufficiently thin to satisfy the flush mounting requirements herein. The substrate body 92 may be formed of any of a variety of nonconductive sheet materials or thin films and may include an adhesive backing. On one side face of the substrate body 92, the traces 10, contacts 12 and switch 14 are permanently formed or attached by any of various methods. Preferably, the contacts 12 are spatially separated from the switch 14 by a trace length dimension LL in the range of 3 to 5 inches. This length is effective to allow placement of the switch 14 at the desired location on the trigger guard on any of a great number of known handgun frames while allowing the carrier 90 to be surface-mounted to locate the contacts 12 at the appropriate location for connection with a laser sight when the sight is secured in the intended manner to the handgun frame.

To accommodate the surface bounds of the handguns of interest, the carrier has a maximum width dimension WW no greater than about 0.5 inch (12.2 millimeter). The overall length of the carrier should be no longer than a dimension within the range of 4 to 5 inches (100 to 127 millimeters). In commercial application, multiple carriers may be provided with different LL dimensions to accommodate different handgun geometries.

An inventive kit enabling fitting a laser sight to any of a number of different handguns includes a laser sight and one or more carriers; each carrier having a different LL dimension and configured to connect to the laser sight when secured to a handgun frame.

Alternative configurations and designs of the inventive switch, contacts and traces may be used in the same manner to carry out the invention. When used with a conductive metal frame handgun, a single contact may be used with a single trace while the gun frame itself is used as a part of a controlling circuit to operate the laser sight in similar manner.

The invention claimed is:

1. A laser sight kit for mounting on a handgun having a triggerguard and a frame extending forward of the triggerguard, comprising: a laser sight configured to be removably secured to the handgun frame at a position forward of the triggerguard, the laser sight having a first electrical contact; a switch operable without displacement of any portion of the switch and without force applied to the switch; at least one second electrical contact; at least one flexible nonconductive carrier, the switch and second contact disposed on carrier with the second contact electrically connected to the switch; and the second carrier, switch and second contact flush surface-mounted when secured to the handgun, with the switch secured to the underside of the triggerguard and the second contact secured to a location forward of the trigger guard such that the laser sight first contact may connect with the second contact.

2. A laser sight kit, according to claim 1, and wherein: the switch comprises metal foil.

3. A laser sight kit, according to claim 1, and wherein: the carrier further comprises at least one flexible conductive trace connecting the switch to the second contact.

4. A laser sight kit, according to claim 3, and wherein: the switch and second contact are located on the carrier with an intervening length dimension in the range of 3 to 5 inches.

5. A laser sight system comprising: a laser removably secured to a handgun frame at a mounting position forward of a handgun triggerguard; a nonconductive carrier extending flushly from a switch position on a downward facing outer surface of the triggerguard to the mounting position; a switch disposed on the carrier at the switch position, the switch operable without displacement of any portion of the switch and with no force applied to the switch; at least one electrical contact disposed on the carrier at the mounting position and electrically connected to the laser when the laser is secured to the handgun frame.

6. A laser sight system according to claim 5, and wherein: the switch comprises metal foil.

7. A laser sight system according to claim 5, and wherein: the switch being operable by a user's finger located below the triggerguard and forward of the rearward end of the triggerguard with a handgun grip.

8. A laser sight comprising: a laser removably secured to a handgun frame at a mounting position forward of a handgun triggerguard; a switch means for controlling the laser by a approach of a user's finger to the underside surface of the triggerguard without the user's finger applying force toward the triggerguard; an electrical contact secured to the handgun frame at the mounting position and configured to connect with the laser when the laser is secured; connection means of electrically connecting the switch to the contact over the surface of the handgun frame; the switch means and connection means disposed flush to the handgun underside surface of the triggerguard and the handgun frame.

* * * * *